US005360321A

United States Patent [19]

Benckert et al.

[11] Patent Number: 5,360,321

[45] Date of Patent: Nov. 1, 1994

[54] FEEDING RESERVOIR FOR TWO-CYLINDERS THICK-MATTER PUMPS

[75] Inventors: Hartmut Benckert, Filderstadt; Helmut Hurr, Reutlingen, both of Germany

[73] Assignee: Putzmeister-Werk Maschinenfabrik GmbH, Aichtal, Germany

[21] Appl. No.: 205,813

[22] Filed: Mar. 3, 1994

Related U.S. Application Data

[63] Continuation of Ser. No. 960,377, filed as PCT/EP91/01161, Jun. 22, 1991, published as WO92/01159 Jan. 23, 1992.

[30] Foreign Application Priority Data

Jul. 3, 1990 [DE] Germany ..... 4021069

[51] Int. Cl.[5] ..... F04B 19/00

[52] U.S. Cl. ..... 417/238; 417/239; 417/900; 137/625.18

[58] Field of Search ..... 417/238, 239, 419, 420, 417/900; 137/625.18, 594

[56] References Cited

U.S. PATENT DOCUMENTS

| | | | |
|---|---|---|---|
| 3,109,457 | 11/1963 | Oliveau | 137/625.18 |
| 3,682,575 | 8/1972 | Guddal | 417/517 |
| 3,889,713 | 6/1975 | Bender . | |
| 4,486,156 | 12/1984 | Feger et al. | 417/900 |
| 4,653,990 | 3/1987 | Schlecht | 417/900 |

FOREIGN PATENT DOCUMENTS

| | | |
|---|---|---|
| 874321 | 6/1979 | Belgium . |
| 1181549 | 11/1964 | Germany . |
| 2235586 | 2/1974 | Germany . |
| 2415276 | 7/1975 | Germany . |
| 8117031 | 3/1983 | Germany . |
| WO81/02043 | 7/1981 | WIPO . |

*Primary Examiner*—Richard A. Bertsch
*Assistant Examiner*—Alfred Basichas
*Attorney, Agent, or Firm*—Kenyon & Kenyon

[57] ABSTRACT

A feeding reservoir for a two-cylinder pump is provided for the pressurized delivery of thick matter. The feeding reservoir includes a material supply port, a front wall having two pump-side ports therein, and a back wall opposite the front wall having two outlet-side ports therein. The pump-side ports lead to the delivery cylinders of the pump, and the outlet-side ports lead to delivery lines. The outlet-side ports are each positioned diametrically opposite to a respective pump-side port, forming two port pairs. A swing pipe is positioned in the reservoir capable of swivelling alternately between one port pair to the other port pair to place the outlet-side port of a port pair in communication with the pump-side port of the port pair. The swing pipe is a straight through-way pipe. Self-adjusting sealing and wearing rings are positioned between the ends of the swing pipe and the pump-side and outlet-side ports for being pressed against the ports under delivery pressure. Spectacle-shaped wearing plates are also positioned at the pump-side ports and at the outlet-side ports. Two radially projecting cover plates are provided at the end of the swing pipe proximate the outlet-side ports for covering the outlet-side port not in communication with the swing pipe to inhibit backflow of the thick matter from the outlet-side port into the feeding reservoir.

22 Claims, 2 Drawing Sheets

FEEDING RESERVOIR FOR TWO-CYLINDERS THICK-MATTER PUMPS

This application is a continuation of application Ser. No. 07/960,377 filed as PCT/EP91/01161, Jun. 22, 1991, published as WO92/01159 Jan. 23, 1992.

BACKGROUND OF THE INVENTION

The invention relates to a feeding reservoir for two-cylinder pumps for the pressurized delivery of thick matter, comprising a preferably upward pointing material-supply port, and two pump-side ports, which are arranged on one front wall and lead to the delivery cylinders, and comprising one outlet-side port, which is arranged on the back wall opposite the front wall and leads to a delivery line, and also comprising a swing pipe, which is arranged inside the reservoir and is capable of swivelling alternately in front of the pump-side ports and which connects these ports to the delivery line, and which bears a self-adjusting, pump-side sealing and wearing ring, which ring is able no be pressed against the pump-side ports under the action of the delivery pressure.

In the case of known feeding reservoirs of this type, which have a pipe switching or cross-over means designed as an S-type manifold or as a trapezoid slide valve, only one delivery line can be charged with the material to be conveyed. Material has to be rerouted in the region of the pipe cross-over. This can lead, above all in the case of the trapezoid slide valve, in areas with a low flow-through rate to material deposits and thus to a gradual build-up in the pipe switching means. Furthermore, in the case of the known pipe switching means, a sealing and wearing plate is provided on the pump side, and this plate is self-adjusting when subjected to wear. This plate is not provided on the outlet side, however. Moreover, in the case of the trapezoid slide valve, a reniform seal is provided on the outlet side. Its complex shape is considered to be disadvantageous, both from a standpoint of production engineering as well as with respect to seal technology.

SUMMARY OF THE INVENTION

Starting from here, the invention is directed toward the task of developing a feeding reservoir of the type mentioned at the outset, whose pipe switching means are capable of being easily sealed and are normally able to charge one or two delivery lines.

To solve this task, the invention proposes that two outlet-side ports be disposed to diametrically oppose, at any one time, one of the pump-side ports, and that the swing pipe, which is designed as a straight through-way pipe, be able to swivel alternately in front of the two outlet-side ports while establishing a connection with one diametrically opposing pump-side port at a time, and that the swing pipe bears a self-adjusting, outlet-side sealing and wearing ring that is able to be pressed against the outlet-side ports under the action of the delivery pressure. The outlet-side ports can lead optionally to two separate pressurized delivery lines or, via a bifurcated pipe, to a shared delivery line.

According to a preferred refinement of the invention, the swing pipe bears two cover plates on its outlet-side end. These cover plates project radially toward opposite sides and, in each case, seal off that outlet-side port which is open toward the inside of the reservoir, while blocking return flow. This ensures that one outgoing pipe is controlled to allow flow through and the other outgoing pipe is sealed off from the feeding reservoir. It is not absolutely necessary thereby to completely seal off the open outlet side. Rather, it often suffices to block return flow, since the material that in some instances flows back from the outlet lines flows back into the feeding reservoir, and can again be delivered in a forward direction at the next opportunity.

The sealing and wearing rings of the swing pipe, which are arranged on the pump side and on the outlet side, advantageously have the same design. In the same way, the pump-side and outlet-side ports of the feeding reservoir can be equipped with spectacle-shaped wearing plates of the same design. These precautionary measures guarantee that wear is automatically compensated for in both directions. In this regard, the straight swing pipe, which exhibits a constant pipe cross-section over its length, contains no dead spaces, in which hardening deposits could form.

BRIEF DESCRIPTION OF THE DRAWINGS

The invention will be clarified in greater detail in the following on the basis of an exemplified embodiment, which is schematically depicted in the drawing. The Figures depict.

DETAILED DESCRIPTION

Figure 1:
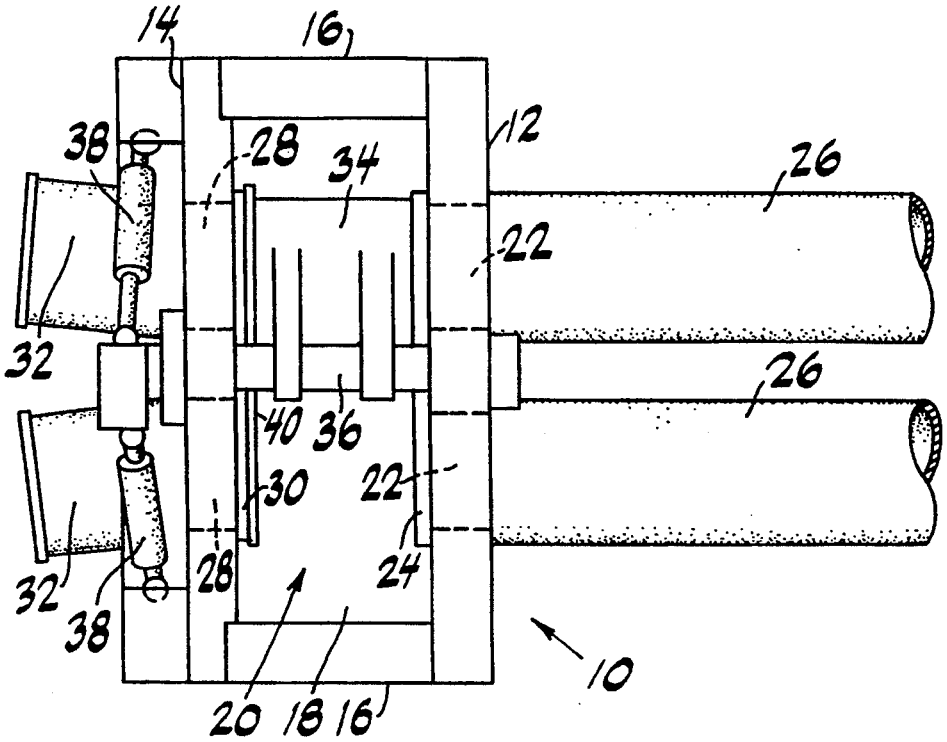
FIG. 1 is a top view of a feeding reservoir of a two-cylinder thick-matter pump comprising a swing pipe; and FIGS. *2a* and *b* are front end views of the swing pipe in two swivel positions.
Figure 2A:
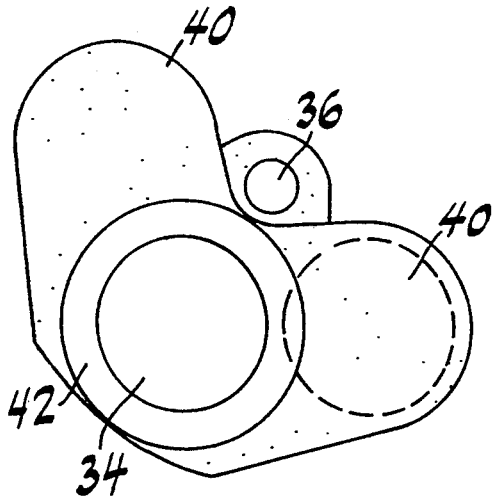
Figure 2B:
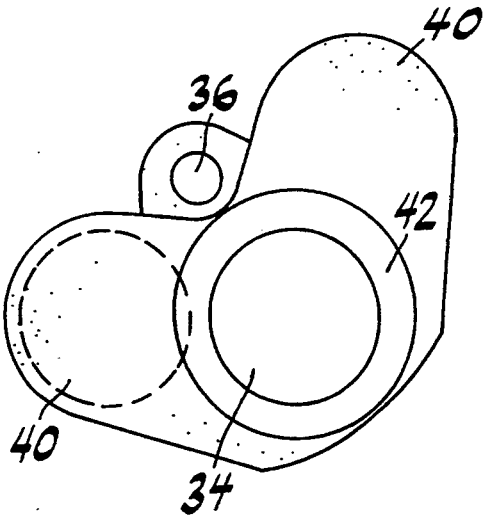

The feeding reservoir 10 shown in FIG. 1 is delimited by a front wall 12, a rear wall 14, two side walls 16, and a reservoir bottom 18, and is charged through a material-supply port 20 from above with the viscous material to be conveyed. Pump-side ports 22 are configured in the front wall 12. They are fitted on the inside of the reservoir with a spectacle-shaped wearing plate 24 (shown in FIG. 4) and are in communication with the two delivery cylinders 26 of a two-cylinder, thick-matter pump. Two outlet-side ports 28 are situated in the rear wall 14. They are fitted on the inside of the reservoir with a spectacle-shaped sealing plate 30 and have delivery connections 32 attached to them on the outside. Two separate delivery lines (not shown) or—via a bifurcated pipe 60—one shared delivery line 62 (shown in FIG. 3) can be connected, in turn, to the delivery connections 32.

A swing pipe 34 designed as a straight through-way pipe is situated inside the feeding reservoir. It can be swivelled by means of a rocking shaft 36 and two plunger-type cylinders 38 with its two ends, alternately in front of the one and the other pump-side and outlet-side port pair. The delivery cylinder, which is coupled via the swing pipe 34 to the corresponding delivery connection 32, always works thereby by delivering under pressure the material to be conveyed that it contains during the pressure stroke, while the delivery cylinder 26, which is open toward the inside of the feeding reservoir 10, works by drawing in the material to be conveyed during the suction stroke.

At its outlet-side end, the swing pipe 34 has two radially projecting cover plates 40, which seal off that outlet-side port 28 which is open at the moment toward the feeding reservoir, to prevent the material to be conveyed from flowing back from the corresponding delivery connection into the feeding reservoir. Furthermore, the swing pipe is fitted at both ends with sealing and wearing rings 42, which are able to be similarly adjusted and pressed tightly against the ports in question in the spectacle plates 24, 30 under the action of the delivery pressure.

To summarize, the following is established: The invention relates to a feeding reservoir for two-cylinder, thick-matter pumps having a switching means designed as a swing pipe 34. Two-pump-side ports 22, which lead to the delivery cylinders 26, are situated at the front wall 12 of the feeding reservoir 10, while two outlet-side ports 28, which lead, respectively, to one delivery connection 32 and one delivery line, are arranged in the opposite rear wall 14. The swing pipe 34, which is designed as a straight through-way pipe, is swivelled alternately in front of the two pump-side and outlet-side ports 22, 28 and connects these ports to one another in pairs. Each of the two ends of the swing pipe is fitted with a sealing and wearing ring 42, which is able to pressed against the adjacent ports under the action of the delivery pressure and automatically adjusted. Furthermore, on its outlet-side end, the swing pipe bears two cover plates 40, which project radially toward opposite sides and, in each case, seal off that outlet-side port 28 which is open toward the inside of the reservoir, while blocking return flow.

We claim:

1. A feeding reservoir for a two-cylinder pump for the pressurized delivery of thick matter, comprising:

a portion having a material supply port therein;

a front wall having two pump-side ports therein, each pump-side port leading to a respective delivery cylinder of the pump;

a back wall opposite said front wall, the back wall having two outlet-side ports therein leading to a delivery line, each outlet-side port positioned opposite a respective one of the pump-side ports;

a swing pipe positioned in the reservoir capable of swivelling alternately between one of the outlet-side ports and the opposite pump-side port to between the other outlet-side port and the other pump-side port, thereby alternately connecting one of the outlet-side ports to the respective opposite pump-side port, the swing pipe being a straight through-way pipe;

a self-adjusting pump-side sealing and wearing ring secured to the swing pipe and positioned between the swing pipe and the pump-side ports for being pressed against the pump-side ports under delivery pressure; and a self-adjusting outlet-side sealing and wearing ring secured to the swing pipe and positioned between the swing pipe and the outlet-side ports for being pressed against the outlet-side ports under delivery pressure.

2. The feeding reservoir of claim 1, further comprising two cover plates coupled with the end of the swing pipe proximate the outlet-side ports for covering an outlet-side port not in communication with the swing pipe to inhibit backflow of the thick matter from said outlet-side port into the feeding reservoir.

3. The feeding reservoir of claim 1, wherein the self-adjusting pump-side sealing and wearing ring and the self-adjusting outlet-side sealing and wearing ring have the same design.

4. The feeding reservoir of claim 1, further comprising spectacle-shaped wearing plates positioned at the pump-side ports and the outlet-side ports.

5. The feeding reservoir of claim 1, wherein the swing pipe has a generally constant cross-section therethrough.

6. The feeding reservoir of claim 1, wherein the outlet-side ports lead to two separate delivery lines.

7. The feeding reservoir of claim 1, wherein the outlet-side ports lead via a bifurcated line to a shared delivery line.

8. A feeding reservoir for a two-cylinder pump for the pressurized delivery of thick matter, comprising:

a portion having a material supply port therein;

a front wall having two pump-side ports therein, each pump-side port leading to a respective delivery cylinder of the pump;

a back wall opposite said front wall, the back wall having two outlet-side ports therein each leading to a separate delivery line, each outlet-side port positioned diametrically opposite a respective one of the pump-side ports thereby forming two port pairs;

a swing pipe positioned in the reservoir capable of swivelling alternately between one port pair to the other port pair to place the outlet-side port of a port pair in communication with the pump-side port of the port pair, the swing pipe being a straight through-way pipe;

a self-adjusting pump-side sealing and wearing ring secured to the swing pipe and positioned between the swing pipe and the pump-side ports for being pressed against the pump-side ports under delivery pressure;

a self-adjusting outlet-side sealing and wearing ring secured to the swing pipe and positioned between the swing pipe and the outlet-side ports for being pressed against the outlet-side ports under delivery pressure, wherein the pump-side sealing and wearing ring has the same design as the outlet-side sealing and wearing ring;

spectacle-shaped wearing plates positioned at the pump-side ports and at the outlet-side ports, the wearing plates each having the same design; and two radially projecting cover plates positioned at the end of the swing pipe proximate the outlet-side ports for covering an outlet-side port not in communication with the swing pipe to inhibit backflow of the thick matter from the outlet-side port into the feeding reservoir.

9. A feeding reservoir for a two-cylinder pump for the pressurized delivery of thick matter, comprising:

a portion having a material supply port therein;

a front wall having two pump-side ports therein, each pump-side port leading to a separate delivery cylinder of the pump;

a back wall opposite the front wall, the back wall having two outlet-side ports therein leading to a delivery line, each outlet-side port corresponding to a respective pump-side port, thereby forming two port pairs;

a swing pipe positioned in the reservoir for swivelling alternately from a first position between one of the port pairs to a second position between the other port pair, thereby alternately placing each of the outlet-side ports in communication with the corresponding pump-side port, the swing pipe being a straight through-way pipe;

a self adjusting sealing and wearing ring secured to one end of the swing pipe for being pressed against the outlet-side ports under delivery pressure within the swing pipe; and a self adjusting sealing and wearing ring secured to the other end of the swing pipe for being pressed against the pump-side ports under delivery pressure within the swing pipe.

10. The feeding reservoir of claim 9, further comprising two cover plates coupled with the end of the swing pipe proximate the back wall for covering the outlet-side port not in communication with the swing pipe to inhibit backflow of the thick matter from said outlet-side port into the reservoir.

11. The feeding reservoir of claim 9, further comprising wearing plates positioned at the outlet-side ports and the pump-side ports.

12. The feeding reservoir of claim 11, wherein the wearing plates are spectacle shaped.

13. The feeding reservoir of claim 9, wherein the swing pipe has a generally constant cross-section therethrough.

14. The feeding reservoir of claim 9, wherein the outlet-side ports lead to two separate delivery lines.

15. The feeding reservoir of claim 9, wherein the outlet-side ports lead via a bifurcated line to a shared delivery line.

16. A feeding reservoir for a two-cylinder pump for the pressurized delivery of thick matter to a delivery line, comprising:

a portion having a material supply port therein;

a front wall having two pump-side ports therein, each pump-side port leading to a respective delivery cylinder of the pump;

a back wall opposite the front wall, the back wall having two outlet-side ports therein leading to the delivery line, each outlet-side port being positioned opposite and corresponding to a respective one of the pump-side ports;

a swing pipe arranged in the reservoir capable of swivelling alternately from a position placing one of the outlet-side ports in communication with a corresponding pump-side port to a position placing the other outlet-side port in communication with the other pump-side port, wherein the swing pipe is a straight through-way pipe;

a self adjusting sealing and wearing ring mounted at one end of the swing pipe for being pressed against the outlet-side ports under delivery pressure within the swing pipe; and another self adjusting sealing and wearing ring mounted at the other end of the swing pipe for being pressed against the pump-side ports under delivery pressure within the swing pipe.

17. The feeding reservoir of claim 16, further comprising two cover plates coupled with the end of the swing pipe proximate the back wall for covering the one outlet-side port not in communication with the swing pipe to inhibit backflow of the thick matter from the one outlet-side port into the reservoir.

18. The feeding reservoir of claim 16, further comprising wearing plates positioned at the outlet-side ports and the pump-side ports.

19. The feeding reservoir of claim 16, wherein the wearing plates are spectacle shaped.

20. The feeding reservoir of claim 16, wherein the swing pipe has a generally constant cross-section therethrough.

21. The feeding reservoir of claim 16, wherein the outlet-side ports lead to two separate delivery lines.

22. The feeding reservoir of claim 16, wherein the outlet-side ports lead via a bifurcated line to a shared delivery line.

* * * * *

UNITED STATES PATENT AND TRADEMARK OFFICE

CERTIFICATE OF CORRECTION

PATENT NO. : 5,360,321

DATED : Nov. 1, 1994

INVENTOR(S) : Benckert et al.

It is certified that error appears in the above-identified patent and that said Letters Patent is hereby corrected as shown below:

Column 1, line 21, "no" should be --to--; and

Column 2, line 30, insert

Figure 3:
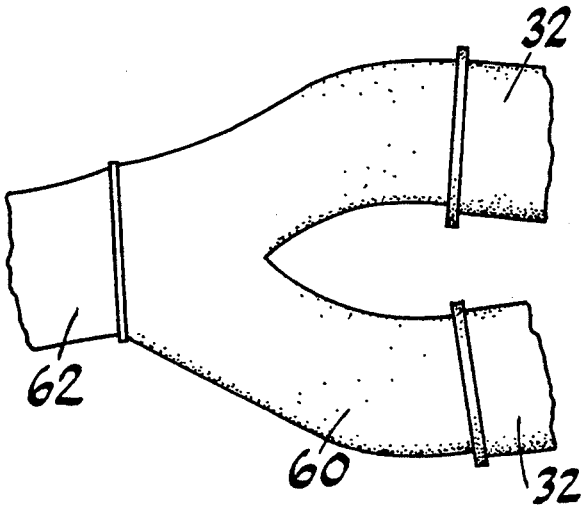

--FIG. 3 is a top view of a bifurcated pipe leading to a single delivery line.

Figure 4:
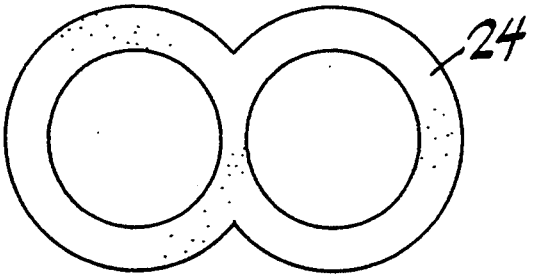

FIG. 4 is a front view of a spectale-shaped sealing plate.--

Signed and Sealed this

Twenty-fifth Day of April, 1995

*Attest:*

Bruce Lehman

BRUCE LEHMAN

*Attesting Officer*

*Commissioner of Patents and Trademarks*